US005215382A

United States Patent [19]

Kemeny

[11] Patent Number: 5,215,382

[45] Date of Patent: Jun. 1, 1993

[54] ISOLATION BEARING FOR STRUCTURES WITH TRANSVERSE ANCHOR RODS

[76] Inventor: Zoltan A. Kemeny, 1919 E. Colgate Dr., Tempe, Ariz. 85283

[21] Appl. No.: 901,497

[22] Filed: Jun. 19, 1992

[51] Int. Cl.[5] ..... E04H 9/02

[52] U.S. Cl. ..... 384/36; 14/73.5; 29/898.15; 52/167 R; 248/634

[58] Field of Search ..... 384/36; 14/73.5; 29/898.055, 898.15; 52/167 R, 167 RM, 167 T, 167 E, 167 EA; 248/634, 636, 638

[56] References Cited

U.S. PATENT DOCUMENTS

| | | | |
|---|---|---|---|
| 4,605,106 | 8/1986 | Fyfe et al. | 14/73.5 X |
| 4,718,206 | 1/1988 | Fyfe et al. | 384/36 X |
| 4,727,695 | 3/1988 | Kemeny | 52/167 |
| 4,823,522 | 4/1989 | White | 52/167 |
| 4,910,930 | 3/1990 | Way | 52/167 R |

FOREIGN PATENT DOCUMENTS

| | | | |
|---|---|---|---|
| 0087464 | 4/1991 | Japan | 52/167 R |
| 0912819 | 3/1982 | U.S.S.R. | 14/73.5 |
| 1299740 | 12/1972 | United Kingdom | 248/634 |

OTHER PUBLICATIONS

"Structural Isolation against Ground Motion, Wind, Vibration and Other Effects"; Brochure by Lorant Group; Nov. 1989.

*Primary Examiner*—Thomas R. Hannon
*Attorney, Agent, or Firm*—Cahill, Sutton & Thomas

[57] ABSTRACT

An isolation bearing for structures includes interlocking channels arranged in pairs of rows in which adjoining pairs of rows can be aligned or staggered. A transverse anchor rod controls the deformation of the side walls of the channels. Kinetic energy is absorbed in the bearing by deformation of the elastomer, deformation of the metal components, and by friction. Elastomer bulge is controlled by plates at the ends of the channels. Stress distribution in the walls of the channels is controlled by oppositely slanted slots. The channels are made from metal tubing or I-beams.

27 Claims, 6 Drawing Sheets

ISOLATION BEARING FOR STRUCTURES WITH TRANSVERSE ANCHOR RODS

BACKGROUND OF THE INVENTION

This invention relates to an isolation bearing for structures and attachments and, in particular, an isolation bearing having several degrees of kinematic freedom.

It is known in the art to isolate a structure from shock and vibration by inserting isolation bearings between the structure and its foundation. One purpose of isolation bearings is to damp vibration coupled to a structure from external sources such as seismic disturbances or vehicular traffic. Another purpose of isolation bearings is to reduce the coupling of dynamic forces to a structure, permitting structures to be constructed to withstand smaller forces than predicted for the site.

An early form of isolation bearing had horizontal plates separated by several layers of elastomer. Vibration was absorbed in the elastomer. Another form of isolation relied on friction between plates in contact to damp vibration. This has some disadvantage because the static friction coefficient between the plates is higher than the sliding friction coefficient. Therefore, a higher force is required to mobilize the energy absorption (hysteretic damping) in this device than the force needed to maintain it.

There is a dichotomy in structural bearings: isolation versus anchor. A highly isolated structure is undesirable because there is too little restraint on its movement. A firmly anchored structure is subject to all ambient forces. It is difficult to provide a bearing which anchors a structure and isolates it.

The isolation bearing disclosed in U.S. Pat. No. 4,910,930 uses a plurality of horizontal, metal plates separated by layers of high damping rubber. Coiled steel rods limit the lateral motion of the plates. High damping rubber is less resilient than low damping rubber, i.e. the energy used to deform or strain the rubber is partially absorbed and converted into heat. In U.S. Pat. No. 4,823,522, a plurality of spaced, vertical metal plates plastically deform to absorb energy applied to the structure. In all of these devices, the number of degrees of freedom is limited, e.g. permitting movement along one or two axes of the bearing.

U.S. Pat. No. 4,727,695 discloses an isolation bearing using opposing plates having interlocking cross-sectional configurations to form a keyed shear and uplift proof element. An elastomer layer between the plates provides shock and vibration isolation and energy dissipation. Although the plates are interlocked, the bearing has several degrees of kinematic freedom and restrains forces and moments in several ways.

Although a bearing under a column of a building does not need more than three degrees of freedom, there are many applications for isolation bearings which require up to six degrees of freedom. To give but two examples: a skewed, elevated roadway on a curved alignment and a ramp connecting a floating dock to a fixed platform. An elevated roadway uses a plurality of sections of roadway supported on piers or columns. The roadway is subjected to forces from many sources, e.g. vehicular traffic, wind, thermal expansion, and seismic disturbances. A bearing on a pier supporting the middle of a section of roadway can twist as adjacent sections shift in an uncoordinated fashion, forcing the top plate of a bearing to rotate or twist with respect to the bottom plate about a vertical axis. In addition to twist, the isolation bearings connecting a ramp to a floating dock must also accommodate rotation, i.e. a tilting of the top plate out of a horizontal plane, as the floating dock rises and falls with the tide.

In view of the foregoing, it is therefore an object of the invention to provide an isolation bearing having more degrees of kinematic freedom than bearings of the prior art with comparable restraining force capacities.

Another object of the invention is to provide an isolation bearing in which stress is uniformly distributed in metal components of the bearing.

A further object of the invention is to provide an isolation bearing which can be made from thinner metal components than those of the prior art, without loss of load capacity or energy dissipating capacity.

Another object of the invention is to provide an isolation bearing having a multi-mode, progressive, energy dissipating characteristic.

A further object of the invention is to dissipate energy in an isolation bearing by deformation of the elastomer and of the metal components and by friction between metal components.

Another object of the invention is to provide an isolation bearing in which the metal components are heat sinks for the elastomer.

A further object of the invention is to provide an isolation bearing in which metal components control the bulge of the elastomer.

A further object of the invention is to provide an isolation bearing in which the elastomer is prevented from slipping along a metal component even though the elastomer no longer adheres to the metal component.

Another object of the invention is to provide an isolation bearing which can be easily adapted to a wide variety of applications.

A further object of the invention is to increase the vertical load carrying capacity of a bearing by controlling elastomer bulge without losing horizontal isolation capacity.

SUMMARY OF THE INVENTION

The invention achieves the foregoing objects by an isolation bearing in which pairs of rows of interlocking channels are held together across their collective widths by anchor rods perpendicular to the lengths of the channels and passing through holes in the walls of the channels. The walls of a channel in one row intersect the open portions of adjoining channels in the other row. Viewed end-on, the channels define a serpentine path or labyrinth repeatedly intersected by the rods. The walls of the channels have bores for the rods and the bores can be enlarged in one or more directions to give the bearing several degrees of kinematic freedom. A top plate and a bottom plate are attached to respective rows. The plates can twist, rotate, and translate relative to each other along at least two orthogonal axes. A suitable elastomer compound is cast in and around the channels between the plates. Additional channels can be added to each row to increase the load capacity of the bearing and additional sets of rows can be added between the top and bottom plates to increase the range of movement. Energy supplied in moving the plates is dissipated in the elastomer. Larger amounts of energy are dissipated by the elastomer and by friction between the channels in a row or between adjacent sets of channels. Even larger amounts of energy are dissipated by deformation of the elastomer, by friction, and by plastic deformation of the channels and rods. The walls of the channels have slots oriented to provide uniform stress across the walls, whereby energy absorption is relatively uniform until failure, i.e. until permanent deformation of the walls. Bolts connecting adjoining sets of rows protrude into the path defined by the channels to provide a secure grip on the elastomer even if the adhesion between the elastomer and the channel should fail. Additional rods, parallel to those mentioned, provide further control of the deformation or bulging of the elastomer at the ends of the channels. Bulge control is optionally achieved by horizontal shim plates or by angle plates bolted to the channels or by side plates bolted through the bearing.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
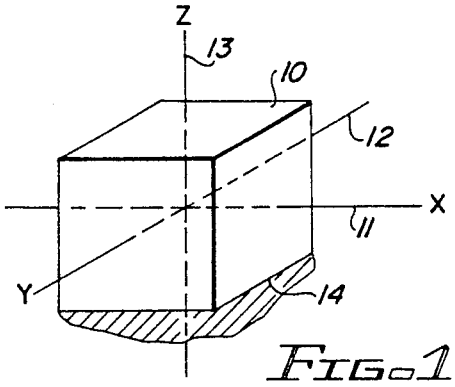
FIG. 1 schematically illustrates an isolation bearing in Cartesian coordinates.

FIG. 1 schematically illustrates an isolation bearing in Cartesian coordinates. Bearing 10 is represented as a cube having sides perpendicular to X-axis 11, Y-axis 12 and Z-axis 13. As indicated by cross-hatching 14, the bottom of bearing 10 is assumed to be attached to a support.

Figure 2:
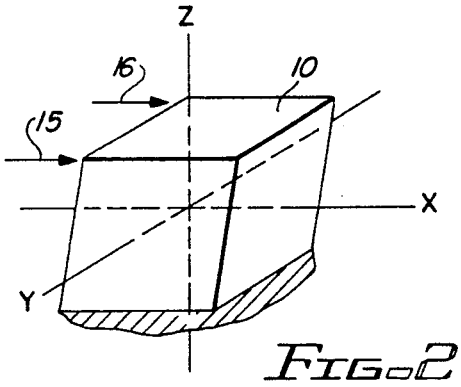
FIG. 2 schematically illustrates translation.

FIG. 2 illustrates what is known as translation, the response to a horizontal or shear force, represented by arrows 15 and 16, applied to bearing 10 in a direction parallel to the X-axis, pointing to the right. The bearing responds to the shear somewhat like a stack of coins, keeping the top and bottom surfaces parallel to each other. The front and back sides deform into parallelograms and the left and right sides tilt. Although the force is indicated as parallel to the X-axis, the force can be applied parallel to the Y-axis or in any direction having components parallel to the X- and Y-axes.

Figure 3:
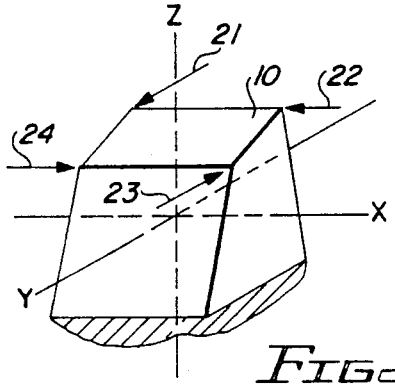
FIG. 3 schematically illustrates twist.

FIG. 3 illustrates what is known as twist, in which the top surface of bearing 10 rotates about the Z-axis. Each of forces 21–24 acting on bearing 10 has a moment with respect to the Z axis, causing the twist. As with translation, the top and bottom surfaces remain parallel to each other. Unlike translation, all of the remaining sides deform into parallelograms.

Figure 4:
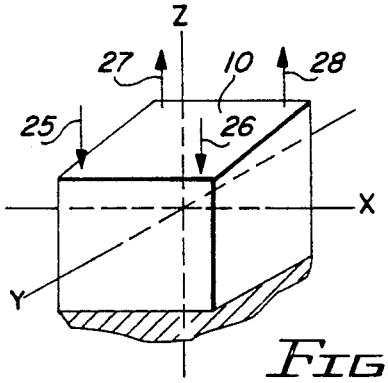
FIG. 4 schematically illustrates rotation.

FIG. 4 illustrates what is known as rotation, i.e. the top surface of bearing 10 rotates away from being perpendicular to the Z-axis. The bearing responds to forces 25,26 or 27,28 by deforming the front and back sides into rectangles and deforming the left and right sides into trapezoids.

Bearing compression (not shown), a force acting vertically downward, deforms the front, back, left and right sides into rectangles.

An isolation bearing constructed in accordance with the present invention can move as indicated in FIGS. 2–4. Although these motions are shown and described separately, it is understood that the motion in a bearing constructed in accordance with the invention can be a combination of compression and the motions shown in FIGS. 2–4. That is, a bearing constructed in accordance with the invention is capable of balancing forces 15–28 in FIGS. 2–4 as well as compression forces.

Figure 5:
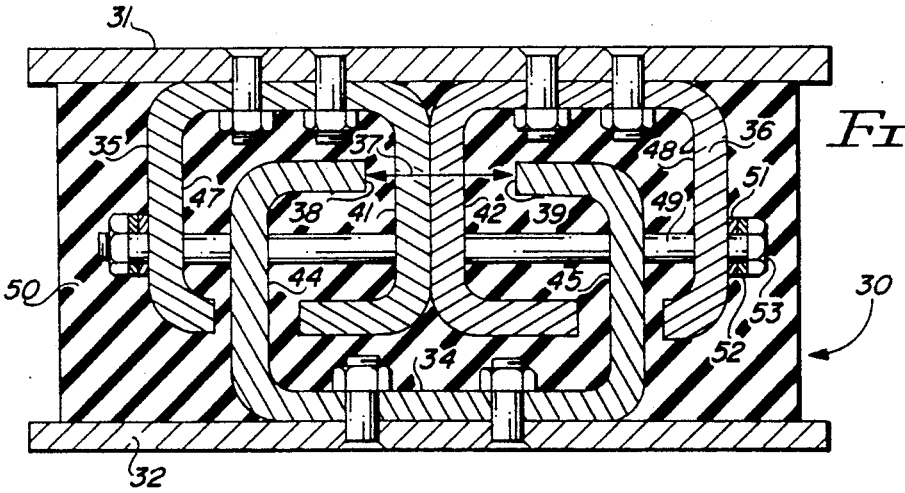
FIG. 5 illustrates the simplest form of an isolation bearing constructed in accordance with the invention.

FIG. 5 illustrates a cross-section of an isolation bearing constructed in accordance with the invention using a minimum number of components. Bearing 30 includes top plate 31 and bottom plate 32 separated by channels 34, 35, and 36. Channels 35 and 36 are bolted or riveted to top plate 31, forming a first row of channels, and channel 34 is bolted or riveted to bottom plate 32, forming a second row having only one channel in it.

Channels 34–36 are made from structural steel tubing having a gap cut along the length of the tubing. Gap 37 between ends 38 and 39 of channel 34 is intersected by right hand side wall 41 of channel 35. Left hand side wall 42 of channel 36 also intersects gap 37. Similarly, wall 44 of channel 34 intersects the gap in channel 35 and wall 45 intersects the gap in channel 36. The result is that channels in one row are staggered from the channels in the other row, like bricks in a wall. This interlocks the channels of the upper and lower rows and defines a labyrinth or serpentine path through the channels having a plurality of perpendicular surfaces, some of which are opposed for transferring energy to the elastomer in the bearing. The labyrinth has four consecutive, right angle turns in the same direction, yet does not end where it began.

The width of the gap and the wall thickness of the tubing may require that the bearing be assembled by sliding one channel longitudinally along another. For example, while wall 41 can be inserted through gap 37, once in place, there may not be enough room for channel 36 to be rotated into place. It may have to be inserted from the end by sliding along the other two channels. This assures a secure interlocking of the channels and prevents the channels from being separated by uplifting.

As used herein, "elastomer" means any viscous, elastic material having appropriate hardness such as natural rubber and elastomers including neoprene, chloroprene, polyurethane, and polyether. A high damping rubber is rubber that, if made into a ball, would not bounce well. The damping characteristic is obtained from appropriate fillers, including air (tiny bubbles), mica, carbon black and others.

A suitable elastomer compound, such as what is known as "50A duro cast" elastomer, is cast in and around the channels between the plates. The "50A" refers to the hardness of the elastomer, after curing, indicating a hardness comparable to that of an automobile tire. For bridges, elevated roadways, and bearings underneath commercial, multi-story buildings, a hardness of from 50A to 60A is Suitable. For lighter applications, a hardness of 40A may be more suitable. As known in the art, the letter "A" refers to a measurement type. Type A measures soft elastomer, while type D measures hard elastomer. A 40A elastomer is like a pink eraser, while a 40D elastomer is almost as hard as wood.

Hardness is a somewhat unscientific term, derived from elasticity and viscosity, used in the art to describe elastomer. By analogy, the characteristic "windchill" is derived from temperature and wind speed. If someone were to say that the windchill was −20° F., he would have said nothing about temperature or wind speed but he would have said what one needed to know: how cold it is. Hardness is similar in that it is a simple way to summarize diverse properties of elastomer.

Anchor rod 49 is transverse to the length of the channels, passing through bores or holes in walls 41, 42, 44, 45, 47, and 48. Anchor rod 49 is threaded its entire length and is held in place by nuts and washers at each end. Elastomer washer 51 is in contact with wall 48 and is separated from nut 53 by flat washer 52. Elastomer washer 51, which has approximately the same hardness as elastomer 50, absorbs shocks to anchor rod 49 and prevents anchor rod 49 from being over-stressed. An anchor rod threaded only at the ends could be used, but a rod threaded its entire length is preferred because it is less expensive and because it increases the mechanical coupling between the rod and the elastomer, preventing the elastomer from sliding along the anchor rod.

In operation, assuming plate 32 rests on a suitable footing or support and a load is applied to plate 31, elastomer 50 compresses and deforms, bulging outwardly. This outward bulging tends to deform walls 47 and 48, bending them outward also. To prevent this, anchor rod 49 interconnects walls 47 and 48, preventing them from spreading. A plurality of such rods are located along the length of the channels. The rods and walls control the deformation of the elastomer and increase the capacity of the bearing. If anchor rod 49, and the other anchor rods, were omitted, walls 47 and 48 of the channels would remain open after a few cyclic shear loadings of the bearing. This would reduce the shear capacity of the bearing.

The elastomer isolates by providing soft elastic coupling and absorbs kinetic energy by converting it into heat. Because the volume of the channels is relatively high compared to the volume of the folded elastomer, the channels act as a heat sink for withdrawing heat from the elastomer. Under severe loading, anchor rod 49 may deform and/or stretch, and walls 47 and 48 may deform permanently as well. The plastic deformation of the metal components also absorbs kinetic energy and prevents the energy from being transmitted to the supported structure. When the restraining elements, i.e. the steel plates and bolts, in an isolation bearing can yield, the mobilized ductility provides energy absorption (hysteretic damping), which reduces the dynamic displacement of the bearing.

The amount of translation in bearing 30 is determined by the hardness of the elastomer and by the size of the gaps in the respective channels. The amount of rotation in bearing 30 is determined by the size and shape of the holes in the side walls. In applications known to require rotation, the holes for the anchor rods are elongated in a direction perpendicular to the length of the channels. This not only permits channels 35 and 36 to move up and down relative to channel 34 but also permits channels 35 and 36 to move slightly relative to each other. Thus, if plate 31 rotates, plates 35 and 36 can move slightly relative to each other, rubbing walls 41 and 42. This rubbing further absorbs kinetic energy, producing heat due to the friction between the walls.

In severe situations, the motion of plates 31 and 32 may cause elastomer 50 to separate from channels 34–36. If the elastomer were permitted to move freely within the channels, the ability of the bearing to absorb energy would be significantly reduced. In order to prevent this, the bolts attaching the channels to the plates protrude into the interior of the channel, into the serpentine path. Thus, even if the elastomer does not adhere to the interior of the channels, the bolts provide a stepped surface and shoulder which will hold the elastomer in place. Thus, each metal component serves dual purposes. The channels confine the elastomer to control its deformation and frictionally engage to dissipate energy; anchor rod 49 controls the spreading of walls 47 and 48 and is itself deformable to further absorb energy. The deformation of the anchor rod can be longitudinal or transverse. The threads on anchor rod 49 engage the elastomer to transfer kinetic energy to the elastomer.

Figure 6:
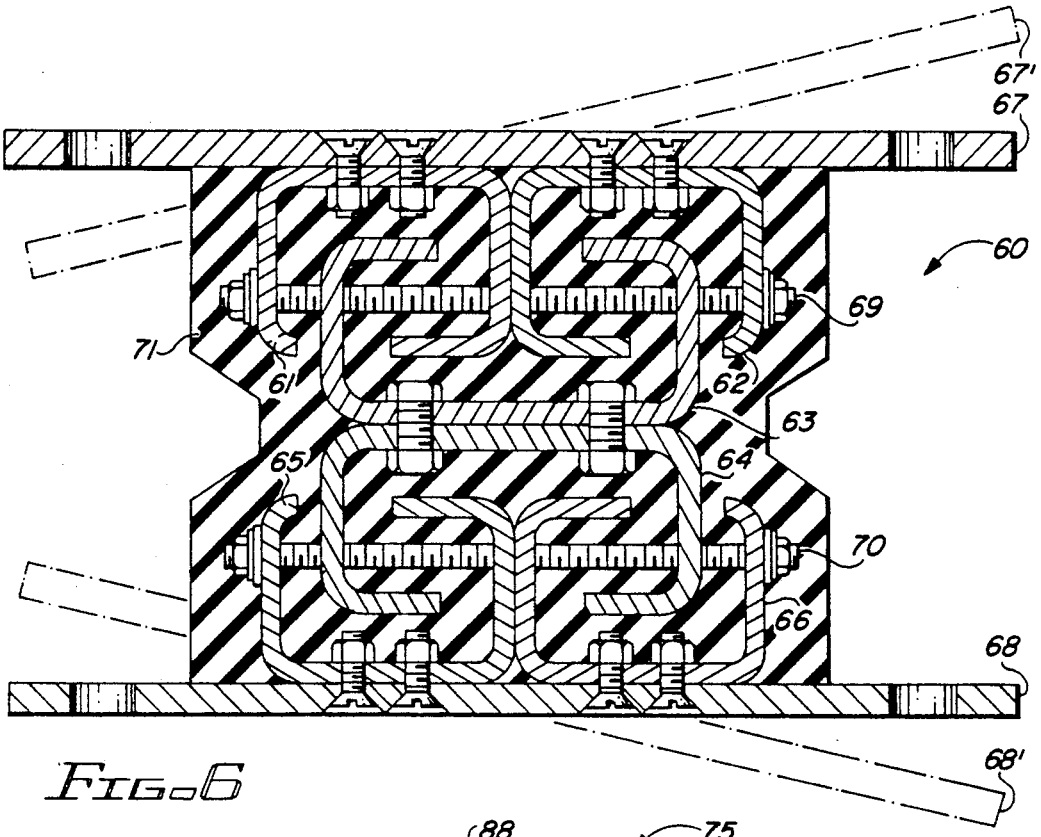
FIG. 6 illustrates an isolation bearing capable of large rotation constructed in accordance with the invention.

Bearing 30 in FIG. 5 represents the smallest unit of a bearing constructed in accordance with the invention, having a first row with just two channels and a second row with but a single channel. Depending upon application, the number of channels in a row or the number of sets of rows can be increased. FIG. 6 illustrates a preferred embodiment of the present invention for connecting a floating dock to a fixed platform. In this application, it is important that the bearing be capable of significant rotation since changes in water level due to tides require that the bearing rotate continuously, two cycles per day for decades.

In the embodiment of FIG. 6, the basic unit illustrated in FIG. 5 is combined with another unit in an inverted configuration, aligning channels in adjoining sets rather than staggering channels in adjoining sets. This hinge-like construction, with fewer channels in the middle of the bearing, increases the amount that the bearing can be rotated.

Bearing 60 includes channels 61–63, constructed as described in conjunction with FIG. 5, and a second set of channels, 64–66. Channels 63 and 64 are connected with their open sides facing away from each other. Plates 67 and 68 are connected to channels 61, 62 and 65, 66. Anchor rod 69 spans channels 61 and 62, holding their outer sides in fixed spatial relationship. Similarly, anchor rod 70 holds channels 65 and 66. Elastomer 71 is cast in and around the channels between plates 67 and 68. The portion of elastomer 71 surrounding the channels preferably has a somewhat uniform thickness, giving the bearing an hourglass outline as seen from the ends of the channels. Due to the spacing of the channels within each other and bolt holes being vertically elongated, plates 67 and 68 can rotate through a significant angle, e.g. plus or minus six degrees from the horizontal, as indicated by plates 67' and 68', shown in dotted line.

Figure 7:
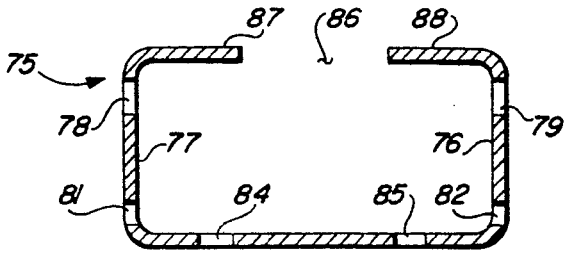
FIG. 7 is a cross-section of steel tubing used for a channel in a bearing.
Figure 8:
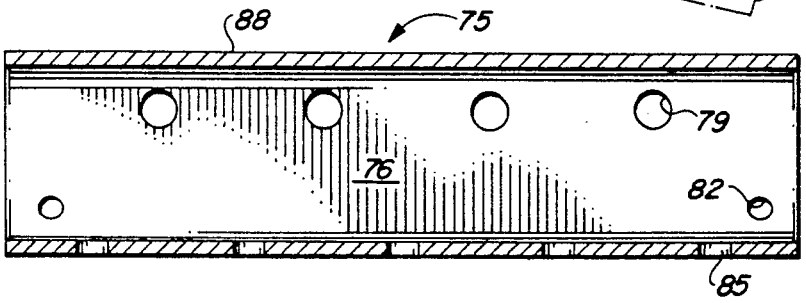
FIG. 8 is a longitudinal cross-section of the channel of FIG. 7.

FIG. 7 is a cross-section of rectangular steel tubing used for channel 34 in FIG. 5 and channels 63 and 64 in FIG. 6. Channel 75 includes side walls 76 and 77 having anchor bores 78 and 79. Anchor bores 78 and 79 are not threaded. As shown in FIG. 8, a plurality of anchor bores are provided along the length of channel 75, in addition to bore 79, for receiving additional anchor rods. Bores 84 and 85, in the bottom of channel 75, are used for connecting adjoining rows of channels. Gap 86 is cut into the top wall of channel 75, preferably removing the weld line from the tubing. Bores 81 and 82 provide clearance for transverse confinement rods, described in conjunction with FIG. 11. The confinement rods are at each end of the channel only and serve to prevent the elastomer from bulging out the ends of the channels.

Although specific dimensions depend upon the intended use of the bearing, a preferred embodiment of the invention used steel tubing having a width of six inches, a height of three inches, and a gap two inches wide. The width of the gap, minus the thickness of the side walls of the adjoining row, is the maximum amount of movement that can occur between adjoining rows without deformation of a channel. For steel having a wall thickness of one quarter inch, the maximum lateral movement is one and three quarter inches. Movement in excess of this limit will deform the channels. Because elastomer is confined between the interlocking channels, the channels will deform before this limit is reached. The design limit, i.e. including channel deformation, for lateral movement in a bearing having these dimensions is about three inches.

Figure 9:
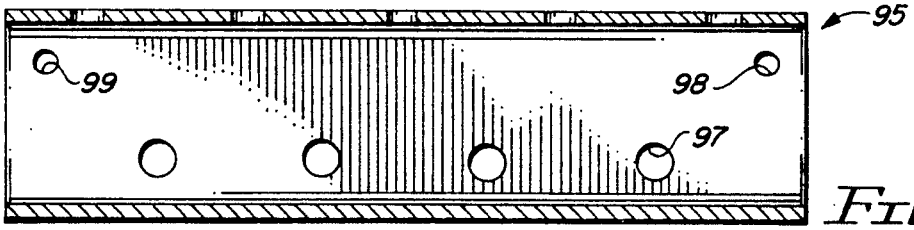
FIG. 9 is a longitudinal cross-section of square steel tubing used for a channel in a bearing.
Figure 10:
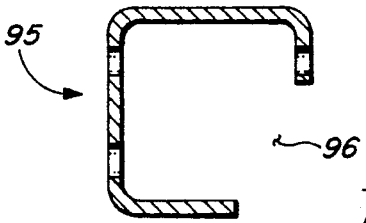
FIG. 10 is a cross-section of the channel of FIG. 9.

FIGS. 9 and 10 illustrate a longitudinal section and a cross-section, respectively, of square tubing used in the bearing. Except for having a square cross-section rather than a rectangular cross-section, the construction of channel 95 is the same as channel 75. In order to accommodate the end of the row, gap 96 is adjacent or includes one corner of channel 95. As can be seen from FIGS. 5 and 6, this provides clearance for the side walls of the rectangular channels. As with the rectangular channels, a plurality of anchor bores, such as bore 97 are provided along the length of channel 95 for clearance of the anchor rods. Similarly, bores 98 and 99 provide clearance for confinement rods at each end of channel 95.

Figure 11:
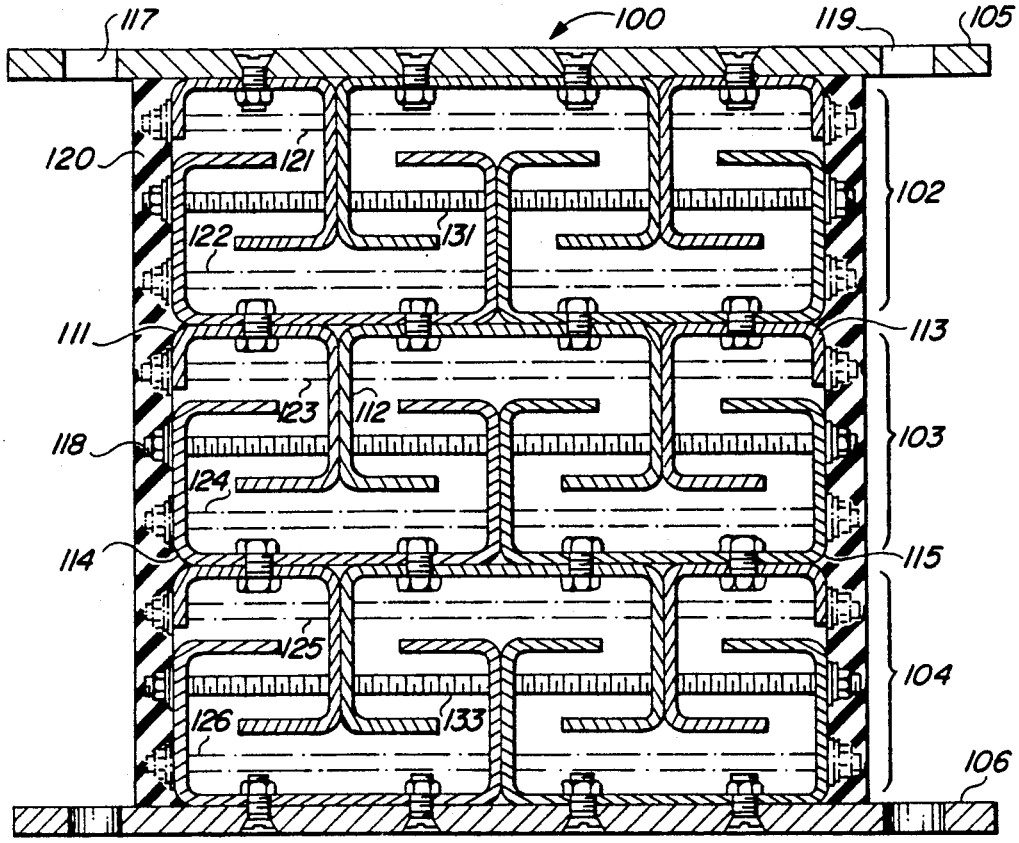
FIG. 11 is a preferred embodiment of an isolation bearing constructed in accordance with the invention.

FIG. 11 is a cross-section of a bearing constructed in accordance with a preferred embodiment of the invention for use between an elevated roadway deck and a supporting column cap, for example. Bearing 100 includes three sets of channels, 102–104, between top plate 105 and bottom plate 106. Each set includes two rows of channels, such as channels 111–113 in a top row and channels 114–115 in a bottom row. In this embodiment, the channels are staggered in adjoining sets. Anchor rod 118 passes through the side walls of all of the channels in set 103 and is attached by nuts and washers at each end, as described previously. Each set of channels is connected to the adjoining set by a plurality of bolts which protrude into the serpentine pathway defined by the respective channels. Top plate 105 is connected to the top row of channels in set 102 and bottom plate 105 is attached to the lower row of channels in set 104, also by bolts protruding into the pathway.

Although countersunk screws are shown in plates 105 and 106, it is understood that other fastening means could be used, for example spot welds or bolts. Bolts projecting above top plate 105 and below bottom plate 106 can be used for securing these plates to concrete. In the event the plates are to be attached to other structural steel, bores such as bores 117 and 119 are provided for this purpose. Elastomer 120 is cast between the plates, in and about the sets of channels, completing the bearing.

A confining rod is attached at each end of the length of each channel. In FIG. 11, confining rods 121–126 are secured in respective rows of channels by nuts and washers at each end. Unlike anchor rods, confining rods pass through the walls of the channels in single row, not both sets of rows. As a force is applied downwardly on plate 105, elastomer 120 tends to bulge outwardly from the plane of the drawing. Confining rods 121–126 prevent the elastomer from doing this. If the bearing is subjected to increased loading or rocking vibration, the confinement rods deform with the elastomer to absorb the kinetic energy. Because the confinement rods are attached near the corners of the channels, relatively little longitudinal stress is placed upon the rods. The stress is mostly transverse, resulting from the deformation of the elastomer. In contrast, most of the stress on the anchor rods, i.e. rods 131, 118, 133, is longitudinal because the sides of the channels tend to bulge outwardly, pivoting about the lower corners.

Figure 12:
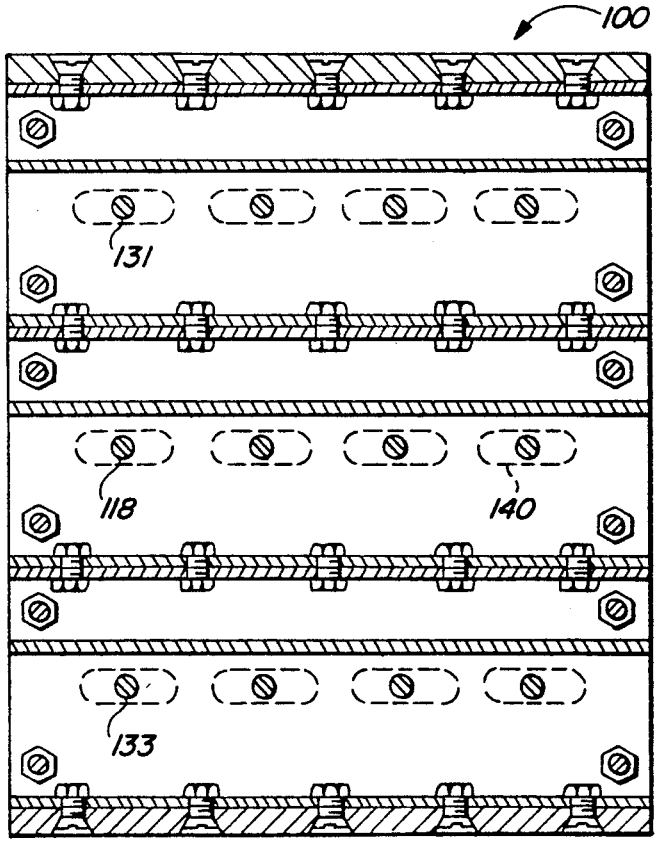
FIG. 12 is a side view of the bearing of FIG. 11.

FIG. 12 is a side view of bearing 100 showing anchor rods 118, 131 and 133, as well as additional anchor rods along the length of respective channels. The ovals shown in dashed lines about each anchor rod, such as oval 140, represent the elongation of the bore parallel to the length of the channel (long slotted hole) to accommodate twist and translation in bearing 100. If bearing 100 were to be subjected to high rotation, then the bores for the anchor rods are elongated vertically. If it were desired to permit both twist and rotation, then the bores are simply made larger in diameter to accommodate both movements, and combinations thereof.

Figure 13:
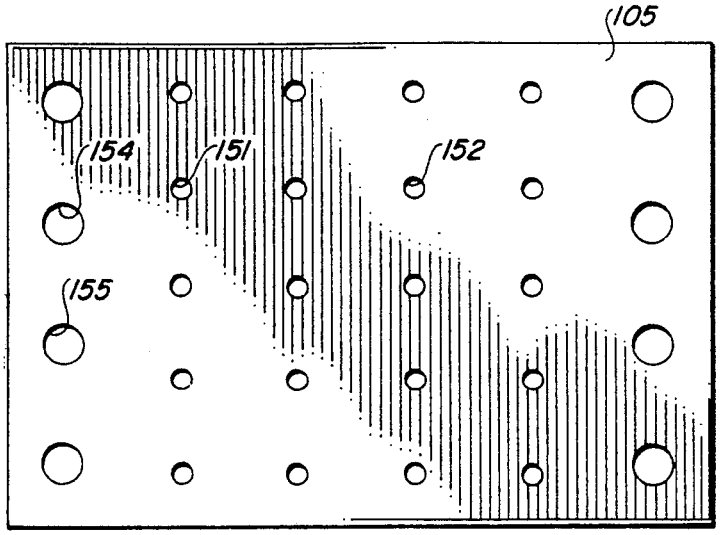
FIG. 13 is a plan view of the top of the bearing of FIG. 11.

FIG. 13 is a top view of plate 105, showing an plurality of bores for attaching plate 105 to the channels and to other structural numbers. An array of smaller bores, such as bores 151 and 152, provide attachment to the channels of the bearing. Larger bores, or punched holes, such as bores 154 and 155 permit plate 105 to be attached to other structural numbers. Although the array of smaller bores is shown as a $4\times5$ array, the bores can be arranged in other arrays, e.g. $4\times8$, to permit side by side sets of channels to be perpendicular to one another for accommodating perpendicular shear forces.

Figure 14:
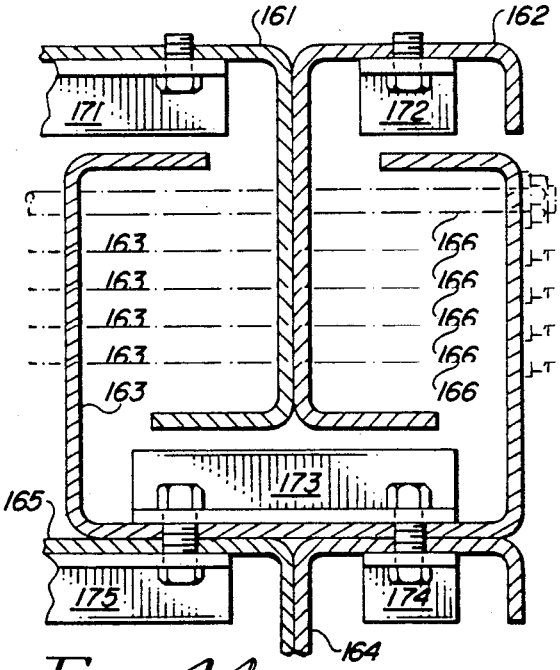
FIG. 14 is a detail of an isolation bearing having confinement plates.

FIG. 14 illustrates an alternative embodiment of the present invention in which confinement plates are used instead of confining rods. FIG. 14 illustrates the upper right hand corner of a bearing including channels 161–165. Anchor rod 166 is connected through the channels as described previously. At each end of the channels is a confinement plate forming a partial end wall along the Serpentine path defined by the channels. Specifically, plates 171–175 are located in channels 161–165, respectively. The confinement plates are preferably made from angle stock and are bolted to the channels. Alternatively, the angle stock could be welded or riveted to the channel.

Figure 15:
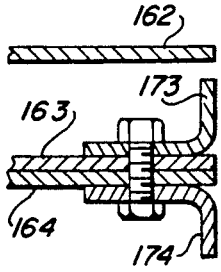
FIG. 15 is a cross-section of the bearing of FIG. 14.

FIG. 15 is a cross-section of the ends of channels 162–164 showing confinement plates 173 and 174. Under compression, the elastomer (not shown in FIG. 15) attempts to bulge from the ends of channels 162–164. Confinement plate 173 controls this deformation by supporting the elastomer. The stress on the confinement plates can eventually cause their deformation as well. While illustrated as attached within the ends of the channels, the confinement plates can be mounted so that they are outside the ends of the channels and extend across a greater fraction of the end of the channel.

Figure 16:
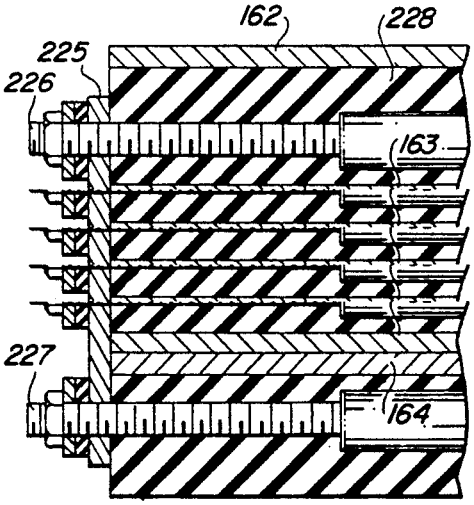
FIG. 16 illustrates an alternative embodiment of a sidewall restraining structure constructed in accordance with the invention.

FIG. 16 illustrates an alternative embodiment of the invention in which angle plates 173 and 174 in FIG. 15 are replaced with a flat plate bolted across the open ends of the channels. The ends of adjoining channels are closed by plate 225, held in place by longitudinal tie rods 226 and 227.

Tie rods 226 and 227 can be threaded through a sleeve or a hole extending through elastomer 228 in the bearing. Casting elastomer 228 is simplified by adding the tie rods after the elastomer is cast. The lack of an adhesive bond between rods 226, 227 and elastomer 228 does not affect energy dissipation. Rods 226 and 227 frictionally engage elastomer 228 sufficiently to hold plate 225 in place.

Plate 225 functions in the same manner as angle plates 173 and 174 in FIG. 15. During periods of high stress, plate 225 restrains elastomer 228 from bulging out the ends of the channels. If yet more deformation occurs, rods 226 and 227 deform along with plate 225, thereby absorbing the additional energy.

Figure 17:
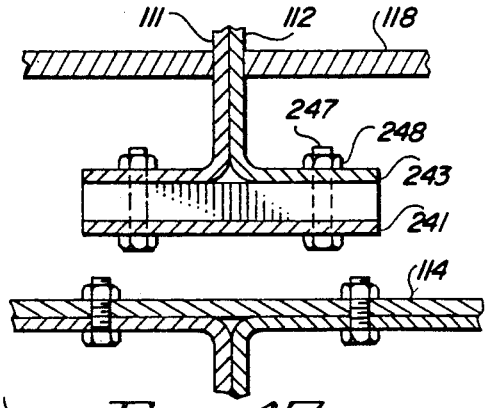
FIG. 17 illustrates an alternative embodiment of a bulge restraining structure constructed in accordance with the invention.
Figure 18:
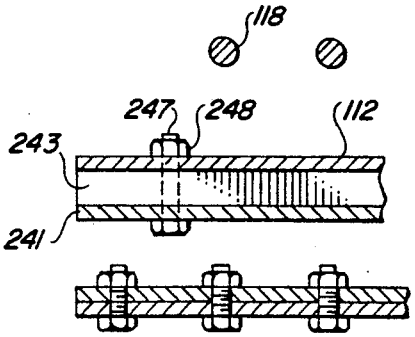
FIG. 18 is a cross-section of the bearing of FIG. 17.

FIGS. 17 and 18 illustrate an alternative embodiment of the invention in which a shim is added to adjoining channels in a row, protruding into the serpentine path. FIG. 17 is a portion of FIG. 11 with the shim added. Specifically, shim 241 is separated from channels 111 and 112 by elastomer layer 243. Elastomer layer 243 preferably has the same hardness as the elastomer (not shown) filling the channels. In a preferred embodiment of the invention, layer 243 is made from re-cycled rubber. Layer 243 is precast and applied to shim 241 prior to shim 241 being attached to channels 111 and 112. The shim and elastomer layer are attached to the channels by any suitable fastening means including bolts, rivets, or screws. Bolt 247 and nut 248 are representative of such fastening means. The fastening means need not be particularly rugged since the only function of the fastening means is to hold shim 241 and layer 243 in place until the bulk of the elastomer is cast in the bearing, filling the channels.

Shim 243 restrains the elastomer in free bulge by the adhesive (surface) bond to the elastomer, rather than by edge pressure as with the angled plates illustrated in FIG. 15. While only a small section of FIG. 11 is illustrated in FIG. 17, it is understood that a plurality of shims are used throughout the bearing in accordance with the invention.

If bolts are used as the fastening means, one has the option of elongating the bolt holes to favor a particular motion. For example, in FIG. 17, the holes for the bolts can be elongated perpendicular to the length of the channels to facilitate translation. Alternatively, the bolt holes can be oversized.

Figure 19:
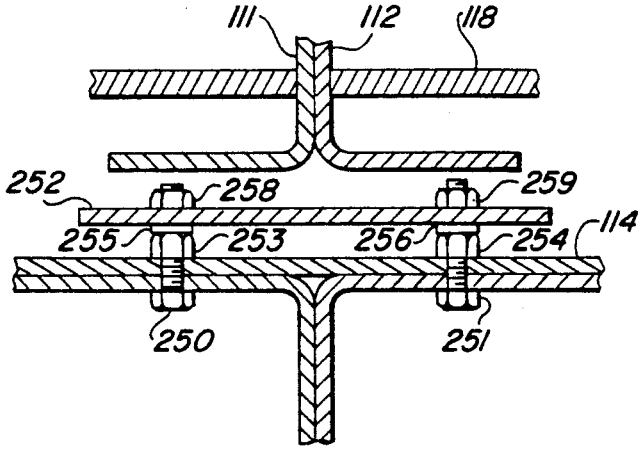
FIG. 19 illustrates an alternative embodiment of a bulge restraining structure constructed in accordance with the invention.
Figure 20:
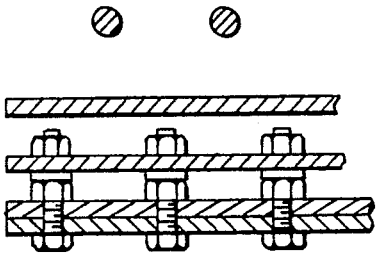
FIG. 20 is a cross-section of the bearing of FIG. 19.

FIGS. 19 and 20 illustrate an alternative embodiment of the invention in which the shim is attached to the broad wall of channel 114, on the other side of the path from where it is attached in FIGS. 17 and 18. In FIG. 19, channels 111 and 112 intersect the gap in channel 114. The broad wall of channel 114 is attached to adjoining channels from another set of channels. In this embodiment, bolts 250 and 251 pass through the channels from the lower set, through holes in channel 114 and holes in shim 252. Bolts 250 and 251 are longer in this embodiment and receive nuts 253 and 254 and resilient washers 255 and 256, between shim 254 and channel 114. Nuts 258 and 259 secure shim 252 to bolts 250 and 251. If desired, the holes in shim 252 can be elongated or enlarged to permit translation. In this embodiment of the invention, all of the elastomer is cast simultaneously. The embodiment of FIGS. 19 and 20 operates in the same manner as the embodiment of FIGS. 17 and 18.

Figure 21:
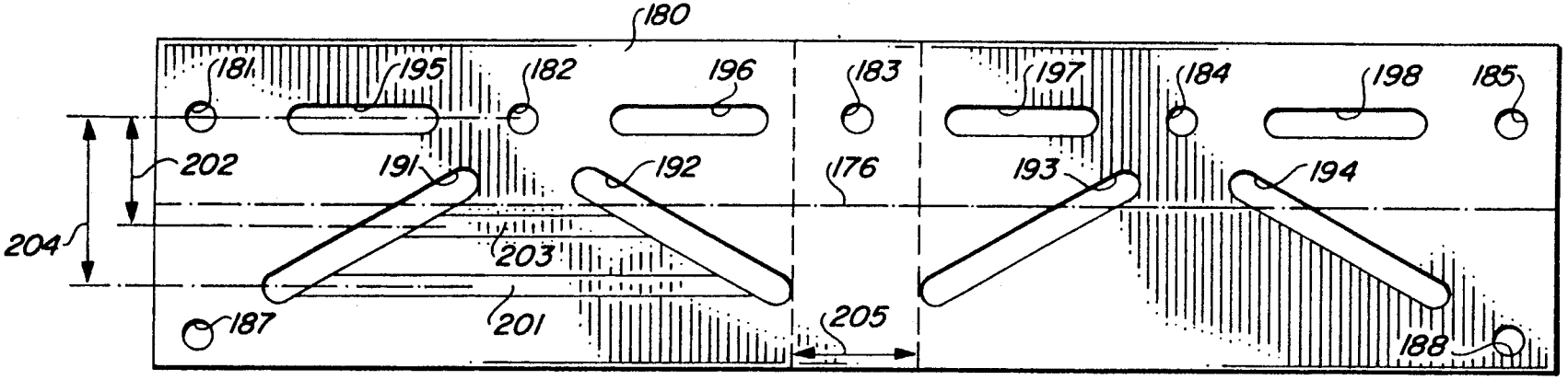
FIG. 21 is an alternative embodiment of the sidewall of a channel constructed in accordance with the invention.

FIG. 21 illustrates a side wall of a channel modified to provide uniform bending stress. In FIG. 21, side wall 180 includes bores 181–185 for anchor rods, as previously described. Bores 187 and 188 receive confinement rods, as previously described. Slots 191–194 are formed in side wall 180 to control the stress in the side wall. Slots 191 and 192 are oppositely slanted to define a triangular region having a width decreasing with height. The angle of the slots is not critical and depends upon the proportions of the wall.

The top of side wall 180 is prevented from bulging outwardly by anchor rods through bores 181–185 and the ductility of the channel. The lower edge of side wall 180 connects to the bottom surface of the channel. Pressure from the elastomer behind side wall 180 is essentially applied to wall 180 above centerline 176 because this is the area of overlap with the adjoining channel from the row above, cf. FIG. 11. This pressure can be considered a force acting along line 177. In area 201, the force has moment arm 202. In area 203, the force has moment arm 204. The stress in wall 180 increases with the distance from line 177 since this distance determines the lever arm of the moment.

In accordance with the invention, slots 191 and 192 separate portions of the wall from the lower edge, causing a uniform stress to be applied on the side wall between slots 191 and 192. For example, without slots 191 and 192, area 203 would be equal to area 201. The stress would be greater in area 201 because lever arm 204 is longer than lever arm 202. In accordance with the invention, area 203 is made smaller than area 201 by slots 191 and 192, thereby increasing the stress in area 203 to approximately equal the stress in area 201.

The area above the slots is decoupled by horizontal slots 195–198, which ensures the above-described uniform stress distribution. The only area not having uniform stress is the region between adjacent pairs of slots indicated by reference numeral 205 in FIG. 21. However, this area can be made reasonably small so that it can only slightly disturb the uniformity of the bending stress distribution of side wall 180.

Figure 22:
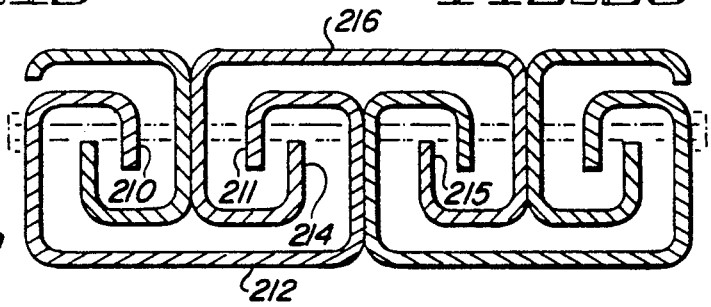
FIG. 22 schematically illustrates a channel constructed in accordance with an alternative embodiment of the invention.

FIG. 22 schematically illustrates an alternative embodiment of the present invention in which the serpentine path is made more convoluted by having six consecutive, right angle turns in the same direction. The added surfaces can be obtained, for example, by cutting the tubing, instead of removing a wide strip, and bending the tubing to form a gap having side walls extending downwardly into the channel. For example, side walls 210 and 211 extend into channel 212 to provide side walls for the gap. Side walls 214 and 215 of channel 216 are aligned with channel 212 to form a significantly more tortuous path, as seen in FIG. 22. This provides coupling across the elastomer (not shown) between adjoining side walls, such as side walls 211 and 214. This coupling increases the restraining and damping capacity of the bearing by adding the deformation of side walls 211 and 214 (and the other additional side walls) to the energy dissipating mechanism of the bearing and by increasing the confinement of the rubber allowing for less free bulge.

Figure 23:
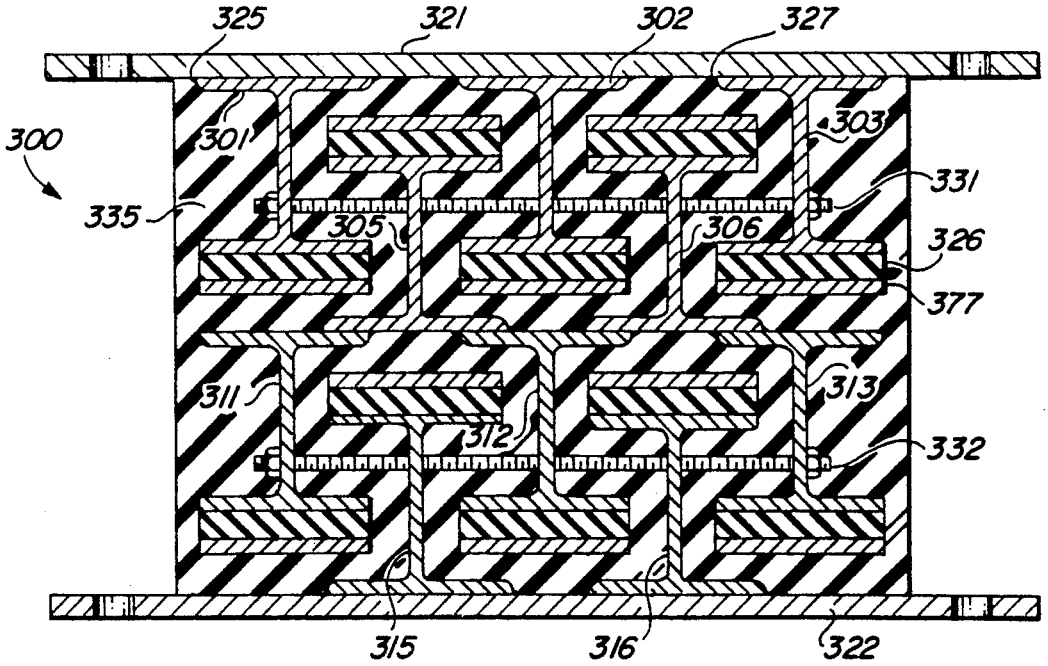
FIG. 23 is a schematic illustration of channels constructed in accordance with another aspect of the invention.
Figure 24:
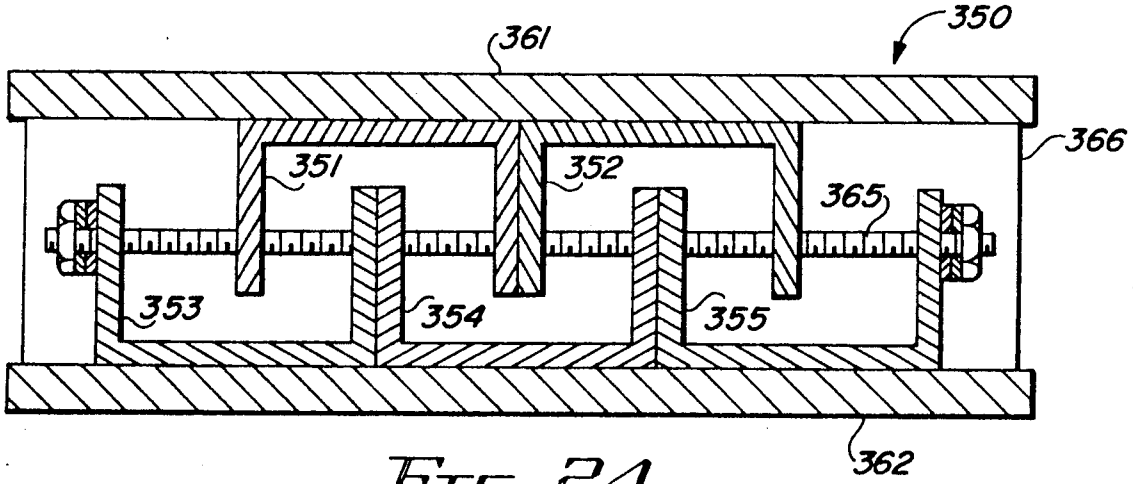
FIG. 24 illustrates an alternative embodiment of a bearing constructed in accordance with the invention.

While illustrated thus far as using rectangular tubing to obtain the serpentine path or labyrinth, a variety of combinations of perpendicular surfaces can be used to produce the labyrinth. For example, FIG. 23 illustrates an embodiment of the invention constructed using I-beams having wide flanges. In this embodiment, beams 301–303 form an upper row and beams 305 and 306 form the lower row in a first set of channels. Similarly, beams 311–313 form a first row and beams 315–316 form the second row of the second set of channels. The top flanges of beams 301–303 are welded to top plate 321, for example as indicated by welds 325 and 327. The lower flanges of beams 305 and 306 are welded to the upper flanges of beams 311–313, as illustrated. The lower flanges of beams 315 and 316 are welded to bottom plate 322. In addition, the free flanges are attached to elastomer layers and shims, such as elastomer layer 326 and shim 327. Anchor rod 331 passes through holes in the webs of beams 301–303, 305 and 306. Similarly, anchor rod 332 passes through the webs of all of the beams in the lower set of channels. As with the other embodiments of the invention, elastomer 335 is cast in and about the channels, completing the bearing. The bearing illustrated in FIG. 23 operates in the same manner as the other bearings except that, because of the welds, elongated bolt holes can not be used between adjoining sets of channels. Elongated or oversized bolt holes can be used in the webs of the beams. The webs and flanges of the beams need not have the same thickness. In the embodiment of FIG. 24, the channels are made from C-shaped stock, i.e. the gap is as wide as the distance between opposing side walls, and the serpentine path is a meander, less convoluted than with the other embodiments. In bearing 350, channels 351 and 352 are in a first row of channels and channels 353–355 are in a second row of channels. Adjacent channels in a row are connected by suitable fastening means (not shown). The first row of channels is connected to plate 361 and the second row of channels is connected to plate 362 by bolts, welds, or screws, not shown in FIG. 24. Anchor rod 365 passes through holes in the side walls of channels 351–355 and is fastened at each end by a flexible washer, a flat washer and a nut. Elastomer 366 fills and surrounds the channels between plates 361 and 362.

Bearing 350 operates as previously described with the other bearings, except that bearing 350 is significantly less uplift-proof than the other bearings since the only member preventing uplift is anchor rod 365. Portions of the channels in the upper and lower rows do not interlock, leaving only anchor rod 365 connecting the rows of channels together. The side walls of channels 351–355 oppose each other across a thickness of elastomer to provide good shear damping and the anchor rod couples the outside walls of the lower row together for increased coupling. The holes in the side walls for anchor rod 365 can be elongated or oversized for translation and/or rotation.

Thus the present invention provides an uplift-proof bearing having more degrees of freedom then bearings of the prior art. In addition, the bearing provides a multi-mode, progressive energy dissipating characteristic. The side walls of the channels control the deformation of the elastomer and contribute to energy dissipation by frictional engagement and by plastic deformation. In addition, a bearing constructed in accordance with the present invention can be adapted for a wide variety of applications by changing one or all of: the number of channels in a row, the number of sets of channels, the orientation of sets of channels relative to each other, the size and shape of the bores for the anchor rods, the hardness of the elastomer, the ductility of the anchor rods, the size and wall thickness of the channels, and the ductility and strength of the channels.

Having thus described the invention it will be apparent to those of skill in the art that various modifications, in addition to the alternatives previously noted, can be made within the scope of the invention. For example, while the washer shown in conjunction with the anchor rod is described as an elastomer washer having approximately the same hardness as the elastomer in the bulk of the bearing, it is understood that any form of resilient washer could be used such as a lock washer, a coiled spring, or a conical washer, to provide a resilient coupling between the nut on the anchor rod and the side wall of the channel.

I claim:

1. An isolation bearing for a structure comprising:

a plurality of interlocked, perpendicular surfaces defining a labyrinth, said labyrinth having a beginning and an end;

at least one anchor rod connected to the surfaces at the beginning and the end of said labyrinth; and a volume of elastomer filling said labyrinth.

2. An isolation bearing for structures comprising:

a plurality of channels, each having a longitudinal gap between opposed side walls;

said channels arranged in at least one pair of rows having the side walls of the channels in one row intersecting the gaps of the channels in the other row in each pair of rows;

said channels each including an anchor bore in each of said side walls;

an anchor rod passing through the anchor bores in all of the channels in each pair of rows;

fastening means at the ends of said anchor rod; and a quantity of elastomer filling said channels.

3. The bearing as set forth in claim 2 and further comprising:

a first plate connected to one of said rows; and a second plate connected to another of said rows.

4. The bearing as set forth in claim 2 wherein said channels are arranged in more than one pair of rows.

5. The bearing as set forth in claim 4 wherein the channels of adjoining pairs of rows are arranged in a staggered relationship.

6. The bearing as set forth in claim 4 wherein the channels of adjoining pairs of rows are aligned with each other.

7. The bearing as set forth in claim 2 wherein said anchor bores are elongated.

8. The bearing as set forth in claim 7 wherein said anchor bores are elongated in a direction parallel to the length of the channels.

9. The bearing as set forth in claim 7 wherein said anchor bores are elongated in a direction perpendicular to the length of the channels.

10. The bearing as set forth in claim 2 wherein said anchor bores are oversized.

11. The bearing as set forth in claim 2 and further comprising:

confinement means transverse to the ends of said channels for containing said elastomer.

12. The bearing as set forth in claim 11 wherein said confinement means includes a plurality of rods, one rod through the ends of the channels in each row.

13. The bearing as set forth in claim 11 wherein said confinement means comprises a plurality of plates connected across respective ends of said channels.

14. The bearing as set forth in claim 13 wherein said plates are angled.

15. The bearing as set forth in claim 11 wherein said confinement means comprises a plurality of plates connected across respective ends of said pairs of channels.

16. The bearing as set forth in claim 2 wherein each channel comprises rectangular tubing of predetermined length.

17. The bearing as set forth in claim 2 wherein said channels comprise I-beams, wherein said side walls are the webs of said I-beams, or C-shaped channels.

18. The bearing as set forth in claim 2 and further comprising:

a plurality of shims, attached to respective ones of said channels and spaced from said channels a predetermined distance.

19. The bearing as set forth in claim 18 wherein said shims are attached to said channels by a layer of elastomer.

20. The bearing as set forth in claim 2 wherein said side walls each include at least one pair of oppositely slanted slots for controlling stress distribution in said side walls.

21. The bearing as set forth in claim 2 wherein said gap is as wide as the distance between said opposed side walls.

22. A method for making an isolation bearing comprising the steps of:

providing a plurality of channels each having a longitudinal gap;

arranging said channels into pairs of interlocking rows;

securing each pair of rows with transverse anchor rods; and filling said channels with a suitable elastomer.

23. The method as set forth in claim 22 and further comprising the step of confining said elastomer with transverse confinement rods at the ends of said channels.

24. The method as set forth in claim 22 and further comprising the step of surrounding said channels with a suitable elastomer.

25. The method as set forth in claim 22 wherein said providing step comprises welding a plurality of I-beams in predetermined spatial relation to produce said channels each having a longitudinal gap.

26. The method as set forth in claim 22 wherein said arranging step includes the step of sliding a first channel longitudinally relative to a second channel.

27. The method as set forth in claim 22 wherein said arranging step includes the step of attaching prefabricated shims to said channels.

* * * * *